US007466940B2

(12) United States Patent
Dalal et al.

(10) Patent No.: US 7,466,940 B2
(45) Date of Patent: Dec. 16, 2008

(54) MODULAR MARKING ARCHITECTURE FOR WIDE MEDIA PRINTING PLATFORM

(75) Inventors: Edul N. Dalal, Webster, NY (US); Mark Sennett Jackson, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 130 days.

(21) Appl. No.: 11/208,871

(22) Filed: Aug. 22, 2005

(65) Prior Publication Data

US 2007/0041745 A1 Feb. 22, 2007

(51) Int. Cl.
*G03G 15/22* (2006.01)
*G03G 15/01* (2006.01)

(52) U.S. Cl. ..... 399/130; 399/300

(58) Field of Classification Search ..... 399/130, 399/299, 300, 301, 302
See application file for complete search history.

(56) References Cited

U.S. PATENT DOCUMENTS

| | | | | |
|---|---|---|---|---|
| 4,579,446 | A | 4/1986 | Fujino et al. | |
| 4,587,532 | A | 5/1986 | Asano | |
| 4,836,119 | A | 6/1989 | Siraco et al. | |
| 5,004,222 | A | 4/1991 | Dobashi | |
| 5,080,340 | A | 1/1992 | Hacknauer et al. | |
| 5,095,342 | A | 3/1992 | Farrell et al. | |
| 5,159,395 | A | 10/1992 | Farrell et al. | |
| 5,208,640 | A | 5/1993 | Horie et al. | |
| 5,272,511 | A | 12/1993 | Conrad et al. | |
| 5,326,093 | A | 7/1994 | Sollitt | |
| 5,435,544 | A | 7/1995 | Mandel | |
| 5,473,419 | A | 12/1995 | Russel et al. | |
| 5,489,969 | A | 2/1996 | Soler et al. | |
| 5,504,568 | A | 4/1996 | Saraswat et al. | |
| 5,525,031 | A | 6/1996 | Fox | |
| 5,557,367 | A | 9/1996 | Yang et al. | |
| 5,568,246 | A | 10/1996 | Keller et al. | |
| 5,570,172 | A | 10/1996 | Acquaviva | |
| 5,596,416 | A | 1/1997 | Barry et al. | |
| 5,629,762 | A | 5/1997 | Mahoney et al. | |
| 5,710,968 | A | 1/1998 | Clark et al. | |
| 5,778,377 | A | 7/1998 | Marlin et al. | |
| 5,884,910 | A | 3/1999 | Mandel | |
| 5,995,721 | A | 11/1999 | Rourke et al. | |
| 6,059,284 | A | 5/2000 | Wolf et al. | |
| 6,076,917 | A * | 6/2000 | Wen | 347/43 |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,348,937 | B2 * | 2/2002 | Hata | 347/116 |
| 6,384,918 | B1 | 5/2002 | Hubble, III et al. | |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Hoang Ngo
(74) *Attorney, Agent, or Firm*—Fay Sharpe LLP

(57) ABSTRACT

In one embodiment, a printing platform is illustrated which includes two or more marking modules offset perpendicular to a process direction to create an aggregate imageable area that is wider than an imageable area of any of the individual marking modules.

16 Claims, 4 Drawing Sheets

U.S. PATENT DOCUMENTS

| | | | | |
|---|---|---|---|---|
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2003/0081227 | A1* | 5/2003 | Williams et al. | 358/1.8 |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed June 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/166,763, filed Jun. 24, 2005, Thayer.
U.S. Appl. No. 11/166,961, filed Jun. 24, 2005, Moore.
U.S. Appl. No. 11/170,873, filed Jun. 30, 2005, Klassen.
U.S. Appl. No. 11/170,975, filed Jun. 30, 2005, Klassen.
U.S. Appl. No. 11/168,152, filed Jun. 28, 2005, German et al.
U.S. Appl. No. 11/170,845, filed Jun. 30, 2005, Sampath et al.

* cited by examiner

MODULAR MARKING ARCHITECTURE FOR WIDE MEDIA PRINTING PLATFORM

BACKGROUND

The embodiments herein relate to multi-marking module, wide media printing platforms. They find particular application to a configuration that combines images created by different marking modules to increase printing width capabilities relative to each individual marking module.

In conventional xerography, an electrostatic latent image is created on the surface of a photoconducting insulator (e.g., a photoreceptor) and subsequently transferred to a final receiving substrate or medium. This typically involves the following. A uniform electrostatic charge is deposited on the photoreceptor surface, for example, by a corona discharge. The photoreceptor is then exposed (via optics, a laser, LEDs . . . ) with an image of the object to be reproduced. The exposure selectively dissipates the surface charge in the exposed regions and creates a latent image in the form of an electrostatic charge pattern. The image is developed by transferring electrostatically charged toner particles to the photoreceptor surface.

The electrostatically charged toner particles are either attracted to the charged (unexposed) regions, or repelled therefrom and deposited in the discharged (exposed) regions. The toner particles are then transferred from the photoconductor to a transfer element (e.g., a transfer belt or drum), and subsequently transferred to a receiving substrate. The transferred image is made permanent by various techniques including pressure, heat, radiation, solvent, or some combination thereof. In a multicolor electrophotographic process, latent images corresponding to different colors are formed on one or more photoreceptors and developed with respective toner. Each single color toner image is transferred to the substrate or intermediate receiver in superimposed registration with the prior toner image(s) to form the multicolor-image.

In conventional marking modules the width of the components used to mark the surface of the photoreceptor is matched to the photoreceptor width, which determines the maximum substrate width which can be usefully printed upon. A common marking engine width seen in office machines is about 12" and is used to reproduce images on letter size (8.5"×11") paper. However, marking engines are produced with various other widths (e.g., 24", 36" or more).

A consequence associated with increasing marking engine width is higher cost. Thus, it is generally more efficient to make marking engines no wider than dictated by the substrate size requirements of the market segment being served. These requirements can vary greatly across market segments. For instance, in a typical office a process width that supports letter size (11" width) is common and sufficient. However, production applications often can demand process widths of 26" or more. In addition to adding cost, increasing marking engine width may result in decreased image uniformity across the width and reduced component reliability (e.g., longer corotron wires). Moreover, producing multiple marking engines with different widths compromises part commonly, which can lead to an inflated cost of ownership.

CROSS REFERENCE TO RELATED PATENTS AND APPLICATIONS

The following applications, the disclosures of each being totally incorporated herein by reference are mentioned:

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. dejong, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 11/051,817, filed Feb. 4, 2005, entitled "PRINTING SYSTEMS," by Steven R. Moore, et al.;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/109,566, filed Apr. 19, 2005, entitled "MEDIA TRANSPORT SYSTEM," by Mandel et al.;

U.S. application Ser. No. 11/166,581, filed Jun. 24, 2005, entitled "MIXED OUTPUT PRINT CONTROL METHOD AND SYSTEM," by Joseph H. Lang et al.;

U.S. application Ser. No. 11/166,961, filed Jun. 24, 2005, entitled "PRINTING SYSTEM SHEET FEEDER," by Steven R. Moore; and U.S. application Ser. No. 11/166,299, filed Jun. 24, 2005, entitled "PRINTING SYSTEM," by Steven R. Moore.

BRIEF DESCRIPTION

In one embodiment, a printing platform is illustrated which includes two or more marking modules offset perpendicular to a process direction to create an aggregate imageable area that is wider than an imageable area of any of the individual marking modules.

DETAILED DESCRIPTION

Figure 1:
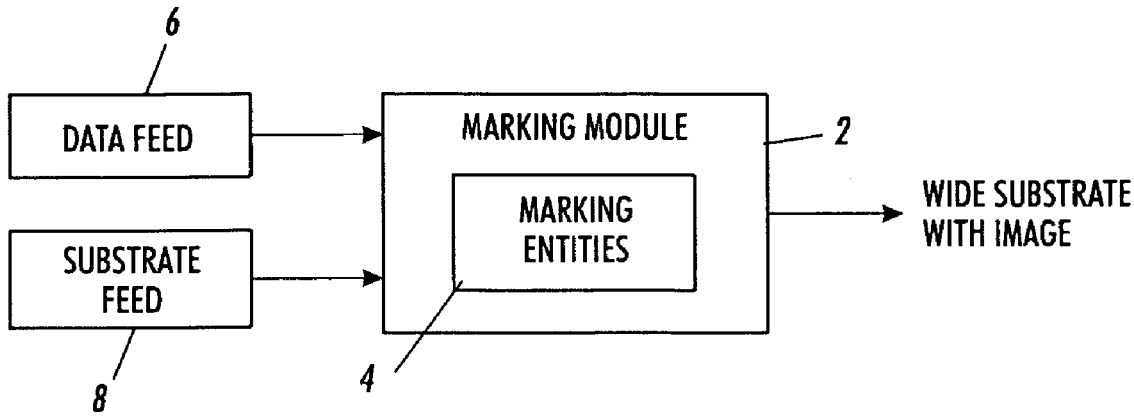
FIG. 1 illustrates a multi-marking module printing platform for reproducing images wider than any one of the individual marking modules.

With reference to FIG. 1, a multi-marking module printing platform 2 (hereafter "printing platform") for reproducing a wide image is illustrated. The printing platform 2 includes at least two marking entities 4, which are staggered (with or without overlap) within the printing platform 2 in a direction parallel to a width of a receiving element and perpendicular to a process direction. Any or all of the marking entities 4 can be used individually and/or in combination to mark at least a portion of an image on a receiving element that may be wider than an image marked by any one of the marking entities 4.

The marking entities 4 can be single-color xerographic engines, multi-color print engines and/or specific xerographic processing elements. A suitable single color xerographic engine may include individual xerographic processing elements such as an expose element, a charge element, a develop element, and a photoreceptor, which facilitate marking an image on a receiving element. A suitable multicolor xerographic engine may include xerographic processing elements such as an expose element, a charge element, a develop element, a photoreceptor, and optionally one or more intermediate transfer elements (belt or drum) for superimposing or combining different colored images to form a multicolored image. Likewise, the multicolor xerographic engine facilitates marking an image on one or more receiving elements.

With a dual-marking engine configuration in which two equal-sized single and/or multicolor marking engines are positioned parallel to one another in a receiving element width direction and perpendicular to a process direction, an image approximately twice the width of any one of the marking engines can be generated. In another non-limiting example, a single and/or multicolor N-marking engine printing platform (where N is an integer greater than one) can mark an image with a width up to approximately the summation of the widths of the N marking engines. In the case of equal width marking engines, the resulting image width would be about N times the width of any single marking engine.

Examples of a marking entity 4 configuration comprising individual xerographic processing elements include two or more of at least one of an expose element, a charge element, and/or a develop element. For example, two or more charge elements may be used to deposit a charge on different portions of a single photoreceptor, which accommodates the full imageable width. Additionally and/or alternatively, two or more expose elements can be used to expose different portions of the single photoreceptor. Additionally and/or alternatively, two or more development elements can be used to transfer charged toner particles to different portions of the single photoreceptor surface. The toner particles can then be transferred from the single photoconductor to one or more receiving elements and/or to a final substrate.

The marking entities 4 can include typical size marking engines and/or xerographic processing elements. Thus, the printing platform 2 can use a plurality of readily available and relatively inexpensive marking entities to support printing to various width substrates without having to use larger width marking modules. The foregoing facilitates parts commonality and re-use, which can decrease cost of ownership, and mitigates producing low volume and/or custom sized wide width marking modules. In addition, image uniformity across the width, relative to wider width marking module, can be increased.

The printing platform 2 can receive data to image from a data feed 6 and a substrate from a substrate feed 8 (e.g., one or more trays). The data feed 6 and/or the substrate feed 8 can be distinct components (as shown) coupled to the printing platform and/or part of the printing platform 2. Image data received from the data feed 6 is reproduced via the marking entities 4 on the substrate obtained from the substrate feed 8 to produce an image that is wider than an image marked by any one of the marking entities 4.

Figure 2:
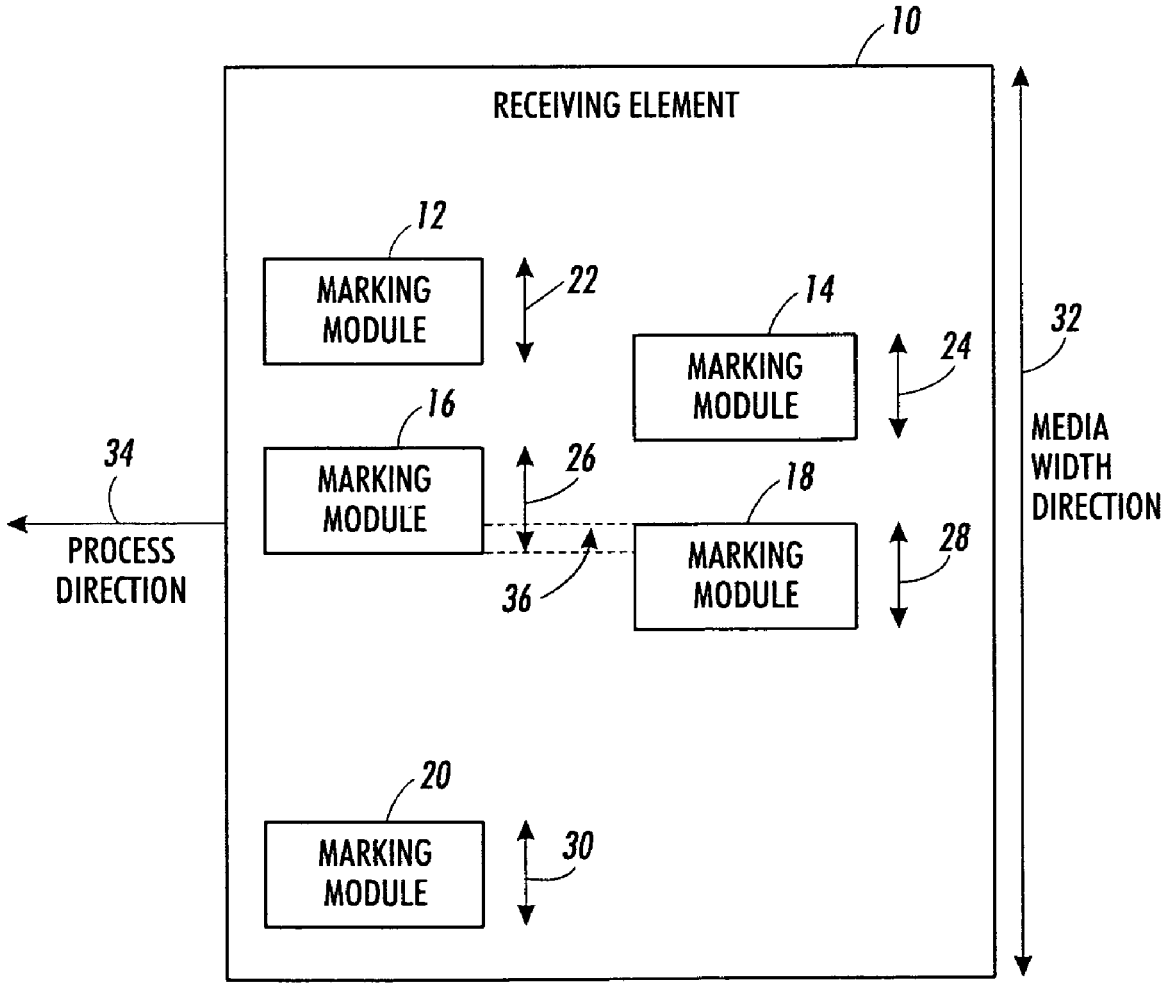
FIG. 2 illustrates an exemplary technique for staggering two or more marking modules with respect to a receiving element.

FIG. 2 illustrates an exemplary technique for staggering multiple marking modules with respect to a receiving element 10. Depicted are a plurality of marking modules 12, 14, 16, 18, and 20, each of which is associated with a corresponding width 22, 24, 26, 28, and 30. The marking modules 12-20 can be used to reproduce an image on the receiving element that is wider than an image marked by any one of the marking modules 12-20. For instance, the resulting image can be as wide as the sum of the widths 22-30.

Adjacent marking modules (e.g., marking module 12 and marking module 14) can be staggered offset parallel from each other in a media width direction 32 and perpendicular to a process direction 34. In addition, adjacent marking modules can be aligned with overlap in the width direction 32 as depicted at 36 and/or without overlap (not shown). Staggering the marking modules 12-20 as such enables imaging over greater widths without having to use larger width marking modules. Thus, existing marking engines and/or other xerographic process elements can be combined and re-used rather than producing custom width marking engines and/or xerographic process elements. For example, existing 12" marking engines can be combined to generate a platform for media widths of about 24", 36", etc. while maintaining low machine Product Acquisition Spending (PAS), lower Unit Manufacturing Cost (UMC), and improved value chains due to higher reuse across multiple markets.

Image registration marks can be placed on the receiving element 10. Such marks can be similar to registration marks applied in tandem design color registration. Image stitching across interfaces can be achieved through known technologies.

With multicolor marking engines, the modules 12-20 can be offset in full-color sets or staggered by color. The latter minimizes the distance and time covering the combination of any given color onto the receiving element 10, which may facilitate the accurate relative registration of the two or more images of the given color. This staggering technique enables cascading of the marking modules 12-20 over a substantial portion of the media width 32 for reproducing images with widths greater than any individual marking module.

FIGS. 3-6 describe dual-marking engine printing platform configurations for reproducing wide images. However, it is to be appreciated that these examples are non-limiting cases of the multi-marking module printing platform 2 described above. Only two marking modules are described for clarity, sake of brevity, and explanatory purposes. It is to be understood that in various other embodiments more than two marking engines and/or multiple xerographic process elements can be used to reproduce wide images as described herein.

Figure 3:
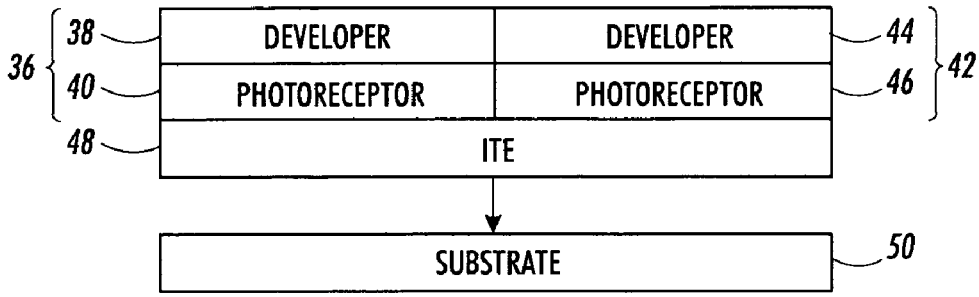
FIG. 3 illustrates a dual-marking engine printing configuration for reproducing a wide image via an intermediate transfer element.

Initially referring to FIG. 3, a dual-marking engine printing configuration for reproducing a wide image via an intermediate transfer element is illustrated. In this example, a first marking engine 36 includes at least a first developer 38 and a first photoreceptor 40. The first developer 38 facilitates transferring charged toner particles to an exposed surface of the photoreceptor 40. In general, a uniform electrostatic charge is deposited on the surface of the photoreceptor 40 by a corona discharge. The photoreceptor 40 is then exposed via optics, a laser, LEDs, etc. with an image of the object to be reproduced. The exposure selectively dissipates the surface charge in the exposed regions and creates an image in the form of an electrostatic charge pattern. The image is developed by transferring the charged toner particles to the surface of the photoreceptor 40. A second marking engine 42 is associated with at least a second developer 44 and a second photoreceptor 46. Likewise, the second developer 44 facilitates transferring charged toner particles to an exposed surface of the photoreceptor 46.

The marking engines 36 and 42 are positioned such that they are offset parallel to one another in a width direction of an intermediate transfer element (ITE) 48 and perpendicular to a process direction. Optionally, the marking engines 36 and 42 are aligned with respect to each other to slightly overlap in the process direction; however, the marking engines 36 and 42 can alternatively be aligned with respect to each other without overlap. Image registration marks can be placed on the intermediate transfer element 48. It is to be understood that the intermediate transfer element 48 is a receiving element similar to the receiving element 10 described above.

The photoreceptors 40 and 46 are shown adjacent to the intermediate transfer element 48, which can be a single transfer belt or a single drum. The marking engines 36 and 42 are utilized to reproduce an image on the ITE 48, and the image can be subsequently transferred to a final substrate 50, which can be paper, velum, and the like. This configuration permits writing and sensing of registration marks on the intermediate transfer element 48, facilitating precise control of alignment of colors across the width, including offsetting all colors at once and/or color-by-color. Alignment can be achieved through actuators such as a combination of electronic image shifting and/or mechanical translation of the downstream engine(s).

Figure 4:
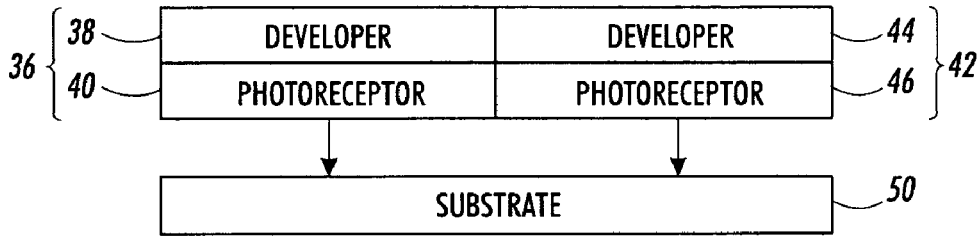
FIG. 4 illustrates a dual-marking engine printing configuration for reproducing a wide image directly on a substrate.

With reference to FIG. 4, an alternative embodiment of the dual-marking engine printing configuration is illustrated. In this example, rather than transferring images to an intermediate transfer element (belt and/or drum) prior to the substrate 50, the substrate 50 is used as the receiving element (e.g., receiving element 10 as described above) and the image is transferred directly from the first and second photoreceptors 40 and 46 to the substrate 50.

Figure 5:
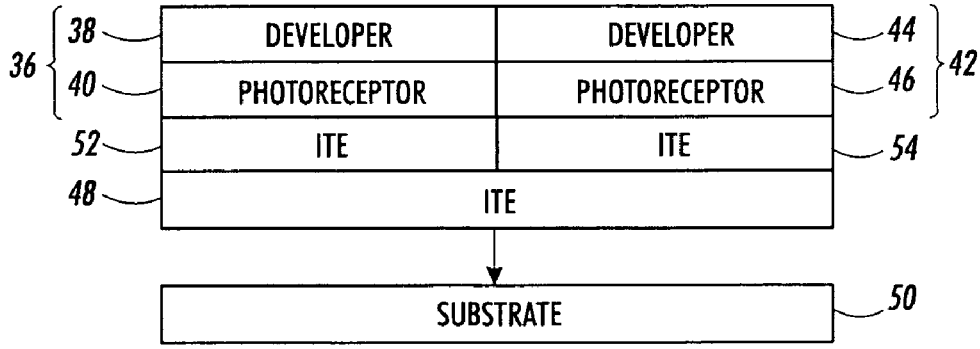
FIG. 5 illustrates a dual-marking engine printing configuration in which each marking engine incorporates its own intermediate transfer element, which is used to transfer a portion of a wide image to a common intermediate transfer element, and the image is subsequently transferred to a final substrate.

With reference to FIG. 5, another alternative embodiment of the dual-marking engine printing configuration is illustrated. With this embodiment, each of the marking engines 36 and 42 incorporates its own ITE 52 and 54, respectively. Images on marked on each of the ITEs 52 and 54 are transferred to and optionally combined on the common ITE 48. Subsequently, the image is transferred from the ITE 48 to the substrate 50.

Figure 6:
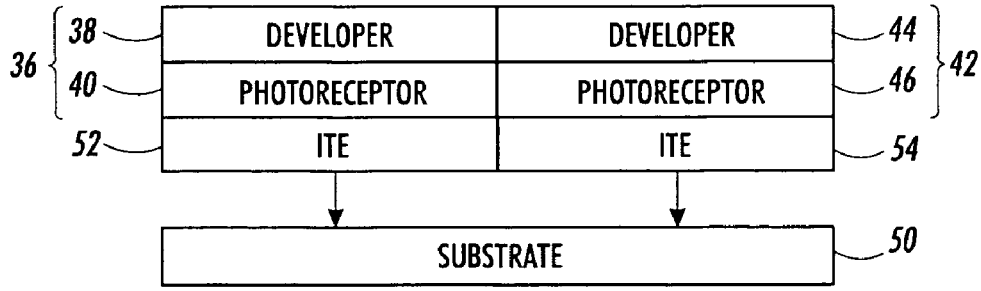
FIG. 6 illustrates a dual-marking engine printing configuration in which each marking engine includes an intermediate transfer element, and images on each of the intermediate transfer elements are transferred directly to a final substrate.

With reference to FIG. 6, another alternative embodiment is illustrated. As with the preceding example, the marking engine 36 includes the intermediate transfer element 52 and the marking engine 42 includes the intermediate transfer element 54. Images marked on each of the intermediate transfer elements 52 and 54 are transferred directly to and combined on the substrate 50.

Figure 7:
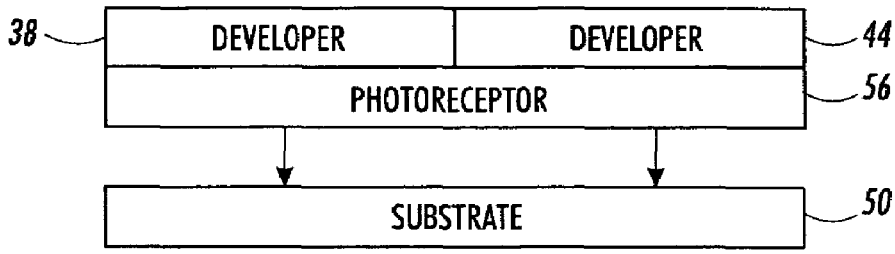
FIG. 7 illustrates a dual-developer printing configuration in which each developer develops a portion of an image on a common photoreceptor and the resultant image is transferred to a final substrate

FIG. 7 illustrates an embodiment in which multiple xerographic processing elements are used to produce a wide image. As discussed above, suitable embodiments may include two or more charge elements that deposit a charge to a single photoreceptor surface, two or more EXPOSE elements that expose portions of the single photoreceptor surface, and/or two or more development elements that transfer charged toner particles to the single photoreceptor surface. This example illustrates a non-limiting example in which two development elements 38 and 44 transfer charged toner particles to a single photoreceptor 56. The photoreceptor 56 accommodates the full image width. The image on the photoreceptor 56 is transferred to the substrate 50. In this example, the photoreceptor 56 is the receiving element.

Figure 8:
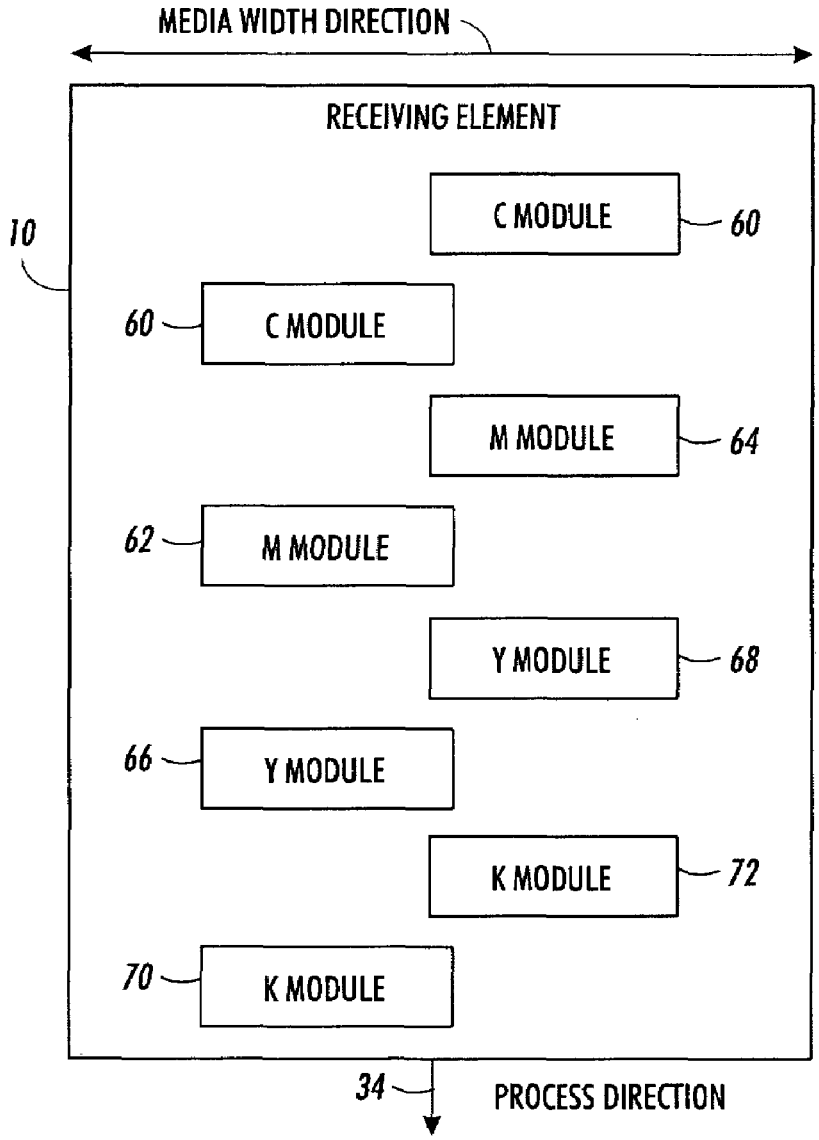
FIG. 8 illustrates staggering of single-color engines to produce wide multicolor prints.

FIG. 8 illustrates sequential staggering of single-color engines to produce wide multicolor prints. As depicted, multiple color modules 58, 60, 62, 64, 66, 68, 70, and 72 are staggered over the receiving element 10, offset parallel in the media width direction 32 and perpendicular to the process direction 34. In this example, the color modules 58 and 60 are cyan modules, the color modules 62 and 64 are magenta modules, the color modules 66 and 68 are yellow modules, and the color modules 70 and 72 are black modules. It is to be appreciated that this example is provided for explanatory purposes and that more or fewer colors and/or more or fewer modules can be employed in various embodiments of the invention. In addition, the ordering of the modules 58-72 is arbitrary and can be similar and/or different in other embodiments.

Similar color marking modules (e.g., marking module 58 and marking module 60) can be staggered offset parallel from each other in the media width direction 32 and perpendicular to the process direction 34. In an alternative instance, the marking modules 58-72 can be staggered by color, which minimizes the distance and time covering the combination of any given color onto the receiving element 10. In addition, adjacent marking modules can be aligned with overlap in the process direction 34 as depicted at 36 and/or without overlap (not shown). Image registration marks such as marks similar to registration marks applied in tandem design color registration can be placed on the receiving element 10. Staggering marking modules in this manner enables imaging over greater widths without having to use larger width marking modules. As discussed previously, the receiving element 10 can be one or more intermediate transfer elements such as drums and/or belts or a final substrate.

Figure 9:
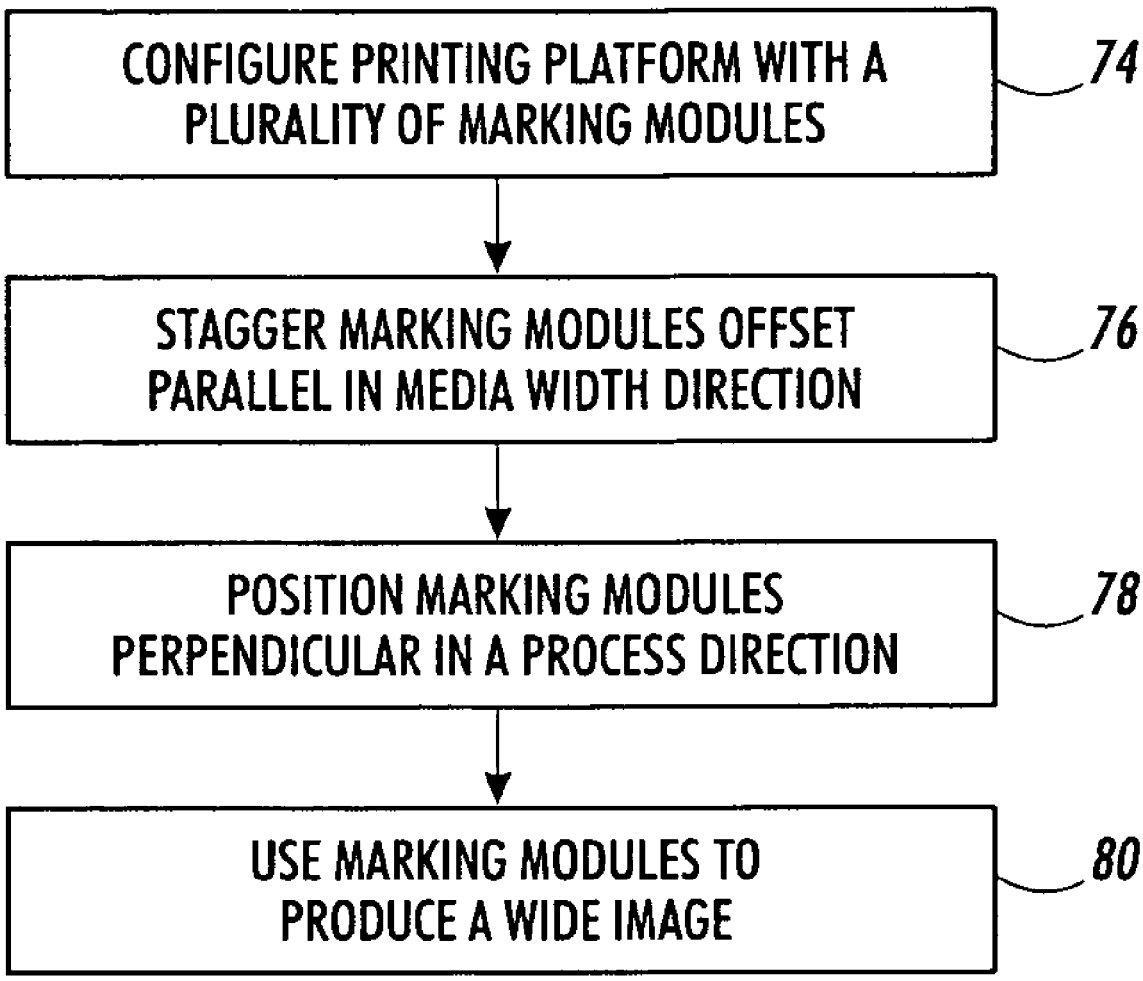
FIG. 9 illustrates a method for facilitating wide media printing with a multi-marking module printing platform that reproduces images wider than any one of the individual marking modules.

FIG. 9 illustrates a method for facilitating wide media printing. At reference numeral 74, a printing platform is configured with at least two marking modules. It is to be appreciated that the marking modules can be single color marking engines, multicolor marking engines, and/or multiple xerographic process elements. At 76, the at least two marking modules are staggered offset parallel in a receiving element width direction. Optionally, the at least two marking modules are staggered such that adjacent marking modules overlap. At 78, the at least two marking modules are positioned perpendicular in a process direction.

At 80, the at least two marking modules are used to produce an image on a substrate in which the image width is greater than an image reproduced by any one of the marking modules. Various approaches can be used to transfer the image to the substrate. For example, in one instance each of the marking modules is associated with a corresponding photoreceptor, and each photoreceptor is used to transfer a portion of an image to a common intermediate transfer element (e.g., a belt and a drum), wherein the portions are subsequently transferred to a final substrate. In another instance, each of the marking modules is associated with a corresponding photoreceptor, and each photoreceptor is used to transfer a portion of an image directly to a final substrate.

In yet another instance, each of the marking modules is associated with a corresponding photoreceptor, and each photoreceptor is associated with a corresponding intermediate transfer element (e.g., a belt and a drum). Images are first transferred from each photoreceptor to each intermediate transfer element, and then the images are transferred from each intermediate transfer element to a common intermediate transfer element (e.g., a belt and a drum), wherein the images are subsequently transferred to a final substrate. In still another instance, each of the marking modules is associated with a corresponding photoreceptor, and each photoreceptor is associated with a corresponding intermediate transfer element (e.g., a belt and a drum). Images are transferred from each photoreceptor directly to a final substrate.

Alternatively, the printing platform can be configured with various combinations of xerographic processing elements as described above. For example, two or more charge elements may be used to deposit a charge on different portions of a single photoreceptor, which accommodates the full imageable width, two or more expose elements can be used to expose different portions of the single photoreceptor, and/or two or more development elements can be used to transfer charged toner particles to different portions of the single photoreceptor surface. The toner particles can subsequently be transferred a final substrate to render a wide image.

It will be appreciated that the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing platform, comprising:

two or more marking modules offset perpendicular to a process direction to create an aggregate imageable area that is wider than an imageable area of any of the individual marking modules, wherein each of said marking modules comprises a developer that facilitates transferring charged toner particles to an exposed surface of a photoreceptor, and wherein process-direction registration of images marked by the two or more marking modules is achieved mechanically by moving one or more of the marking modules or digitally by adjusting the timing of the rendering of the respective portions of an incoming image between the at least two marking modules.

2. The printing platform as set forth in claim 1, wherein the two or more marking modules are offset from each other with or without overlap.

3. The printing platform as set forth in claim 1, wherein the two or more marking modules are single or multi-color marking engines.

4. The printing platform as set forth in claim 1, further including an intermediate transfer element that is marked by each of the two or more marking modules to create an image with a width up to about a summation of individual widths of the at least two marking modules.

5. The printing platform as set forth in claim 4, wherein the intermediate transfer element is a transfer belt or a drum.

6. The printing platform as set forth in claim 4, wherein two or more portions of the image are aligned on the intermediate transfer element through one or more registration marks located on the intermediate transfer element.

7. The printing platform as set forth in claim 6, wherein the alignment on the intermediate transfer element is achieved through at least one of electronic image shifting and mechanical translation of a downstream engine.

8. The printing platform as set forth in claim 1, further including a plurality of single-color marking modules offset perpendicular and parallel to a process direction to create a multi-color image that is wider than an image created by any of the individual marking modules.

9. The printing platform as set forth in claim 1, wherein the two or more marking modules include electrophotographic image forming elements that act upon a common photoreceptor to create an image with a width up to about a summation of individual widths of the electrophotographic image forming elements.

10. The printing platform as set forth in claim 9, wherein the electrophotographic image forming elements include one or more components that charge a photoreceptor surface in preparation for creation of a latent image, create the latent image through an exposure, and/or develop the latent image.

11. The printing platform as set forth in claim 9, wherein one or more portions of the image are aligned on the photoreceptor surface through one or more registration marks located on an associated photoreceptor.

12. The printing platform as set forth in claim 1, wherein lateral registration of images marked by the two or more marking modules is achieved mechanically by moving one or more of the marking modules or digitally by adjusting the distribution of an incoming image between the at least two marking modules.

13. A method for facilitating wide media printing, comprising:

staggering at least two marking modules offset parallel in a substrate width direction of a printing platform, wherein each of said marking modules comprises a developer that facilitates transferring charged toner particles to an exposed surface of a photoreceptor;

providing the printing platform with image data for an image with a width greater than a width of either of the at least two marking modules;

marking different regions of one or more first transfer elements with portions of the image data, each region being marked with a different portion of the image data by a different marking module; and transferring the image data on the one or more first transfer elements to a common substrate; and registering images in process-direction marked by the two or more marking modules by mechanically moving one or more of the marking modules or digitally adjusting the timing of the rendering of the respective portions of an incoming image between the at least two marking modules.

14. The method as set forth in claim 13, further comprising using a subset of the at least two marking modules to generate an image across a width of the substrate.

15. The method as set forth in claim 13, further comprising using the at least two or more marking modules to concurrently create independent imageable areas for jobs with widths up to an imageable area of the individual marking modules.

16. A xerographic printing system, comprising:

a plurality of xerographic elements for marking different portions of an image on different regions of a transfer element, the plurality of xerographic elements being positioned parallel in a substrate width direction to extend printing width capabilities, and offset perpendicular to a process direction; and a control component that receives image data with a width greater than a width associated with any one of the plurality of xerographic elements and partitions the image data across the plurality of xerographic elements, and the plurality of xerographic engine elements mark the transfer element with respective portions of the image data;

wherein process-direction registration of images marked by the plurality of xerographic elements is achieved mechanically by moving one or more of the xerographic elements or digitally by adiusting the timing of the rendering of the respective portions of an incoming image between the xerographic elements.

* * * * *